US006996356B2

(12) United States Patent
Atsumi

(10) Patent No.: US 6,996,356 B2
(45) Date of Patent: Feb. 7, 2006

(54) IMAGE FORMING APPARATUS USING SYSTEM FOR CLEANING IMAGE BEARING MEMBER

(75) Inventor: Tetsuya Atsumi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 10/753,374

(22) Filed: Jan. 9, 2004

(65) Prior Publication Data

US 2004/0141769 A1 Jul. 22, 2004

(30) Foreign Application Priority Data

Jan. 17, 2003 (JP) ..... 2003-009069

(51) Int. Cl.
*G03G 21/00* (2006.01)
*G03G 15/02* (2006.01)

(52) U.S. Cl. ..... 399/129; 399/50; 399/174; 399/176

(58) Field of Classification Search ..... 399/50, 399/128, 129, 149, 150, 174, 175, 176; 430/56, 430/902

See application file for complete search history.

(56) References Cited

FOREIGN PATENT DOCUMENTS

JP 2000-284570 * 10/2000

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member capable of being rotated, a first charging unit, an electrostatic image forming unit, a developing unit, and a second charging unit. The first charging unit is capable of being rotated in the same direction as a rotational direction of the image bearing member with being in contact with the image bearing member, and is capable of charging the image bearing member and toner on the image bearing member. The electrostatic image forming unit is capable of forming an electrostatic image on the image bearing member charged by the first charging unit. The developing unit is capable of collecting the toner on the image bearing member and visualizing the electrostatic image. The second charging unit is disposed downstream of the first charging unit along the rotational direction of the image bearing member, is capable of being rotated in a direction opposite to the rotational direction of the image bearing member with being in contact with the image bearing member, and is capable of charging the toner on the image bearing member.

4 Claims, 8 Drawing Sheets

IMAGE FORMING APPARATUS USING SYSTEM FOR CLEANING IMAGE BEARING MEMBER

BACKGROUND OF THE INVENTION

1. Field of the Invention

The present invention relates to an image forming apparatus, such as a copying machine, using an electrophotographic system or an electrostatic recording system, and particularly to a so-called cleaner-less system in which residual toner remaining on an image bearing member is collected by a developing device for re-use.

2. Related Background Art

In recent years, image forming apparatuses, such as copying machines, have been reduced in their sizes, but limitations to the down-sizing are likely to occur if only units for performing electrification, exposure, development, transfer, fixation, and cleaning are down-sized.

Further, in an image forming apparatus of a type in which a toner image formed on a photosensitive member serving as the image bearing member is transferred to a recording material or the like, residual toner remaining on the photosensitive member after the transferring process is collected by a cleaner, and becomes a waste toner. Such disposal is, however, not preferable from the standpoint of an environmental aspect.

Accordingly, there has been proposed a so-called cleaner-less system in which residual toner remaining on a photosensitive member is charged by a charging roller serving as a charging unit for charging the photosensitive member, and is collected by a developing unit for re-use.

In the image forming apparatus using such a cleaner-less system, the residual toner remaining on the photosensitive member after the transfer is simultaneously charged in the same electrical polarity as the photosensitive member when the photosensitive member is electrified by the charging roller. Further, collection of unnecessary toner on the photosensitive member is performed by electrostatically collecting toner attached to a non-image portion in an image zone by the developing unit when an electrostatic image on the photosensitive member is developed. Here, the charging roller is rotated in the same direction as a rotational direction of the photosensitive member.

FIG. 2 schematically illustrates a manner in which the residual toner on a photosensitive member 1 is charged by rotation of a charging roller 20 in the same direction as the rotational direction of the photosensitive member 1. A residual toner 14 remaining on the photosensitive member 1 is brought into contact with the charging unit 20 at an upstream end portion A1 along the rotational direction of the photosensitive member 1 in a contact portion N11 between the charging roller 20 and the photosensitive member 1, and is hence electrified. Since the rotational direction of the charging roller 20 is the same as that of the photosensitive member 1, the toner 14 on the photosensitive member 1 is scraped off by the charging roller 20, and moved to the charging roller 20. The toner 14 moved to the charging roller 20 is again rubbed off by the photosensitive member 1 at a downstream end portion A2 along the rotational direction of the photosensitive member 1 in the contact portion N11, and is moved to the photosensitive member 1 once again.

Further, the toner 14 on the charging roller 20 is electrostatically reciprocated between the charging roller 20 and the photosensitive member 1 in the vicinity of the contact portion N11 by an alternating AC voltage applied to the charging roller 20. Accordingly, the toner 14 on the charging roller 20 can be readily moved to the charging roller 20, or the photosensitive member 1. At this time, the toner 14 is not present in the contact portion N11. Therefore, the charging roller 20 is brought into direct contact with the photosensitive member 1, and hence the photosensitive member 1 is appropriately electrified.

However, in cases where the amount of the residual toner 14 remaining on the image bearing member 1 is large, such as a case where an image ratio is high in the image zone of a previous image, and an image using a plenty of toner is transferred on a recording medium, it is difficult for the above-discussed charging roller 20 to electrify the toner 14 on the photosensitive member 1 to a sufficient degree.

In other words, much residual toner is accumulated near the end portion A1, and a portion of the residual toner 14 is rubbed off from the photosensitive member 1 to the charging roller 20 without being in direct contact with the charging roller 20. On such an occasion, the toner 14 without direct contact with the charging roller 20 is not charged to a sufficient degree. Such non-electrified residual toner 14 is not collected by the developing device. Thus, the problem that the toner remains on the non-image portion in the image zone is liable to occur.

SUMMARY OF THE INVENTION

It is an object of the present invention to solve the problem that residual toner remains on a non-image portion in an image zone, even in the event that a plenty of residual toner remains on an image bearing member, in an image forming apparatus which uses a cleaner-less mechanism for charging the residual toner remaining on the image bearing member and collecting it by a developing unit.

It is another object of the present invention to provide an image forming apparatus which include an image bearing member capable of being rotated; a first charging unit which is capable of being rotated in the same direction as the rotational direction of the image bearing member with being in contact with the image bearing member, and is capable of charging the image bearing member and toner on the image bearing member; an electrostatic image forming unit for forming an electrostatic image on the image bearing member charged by the first charging unit; a developing unit for collecting the toner on the image bearing member and visualizing the electrostatic image; and a second charging unit which is disposed downstream of the first charging unit along the rotational direction of the image bearing member, is capable of being rotated in a direction opposite to the rotational direction of the image bearing member with being in contact with the image bearing member, and is capable of charging the toner on the image bearing member.

These and further aspects and features of the invention will become apparent from the following detailed description of preferred embodiments thereof in conjunction with the accompanying drawings.

DESCRIPTION OF THE PREFERRED EMBODIMENTS (Entire Structure of an Image Forming Apparatus)

Figure 1:
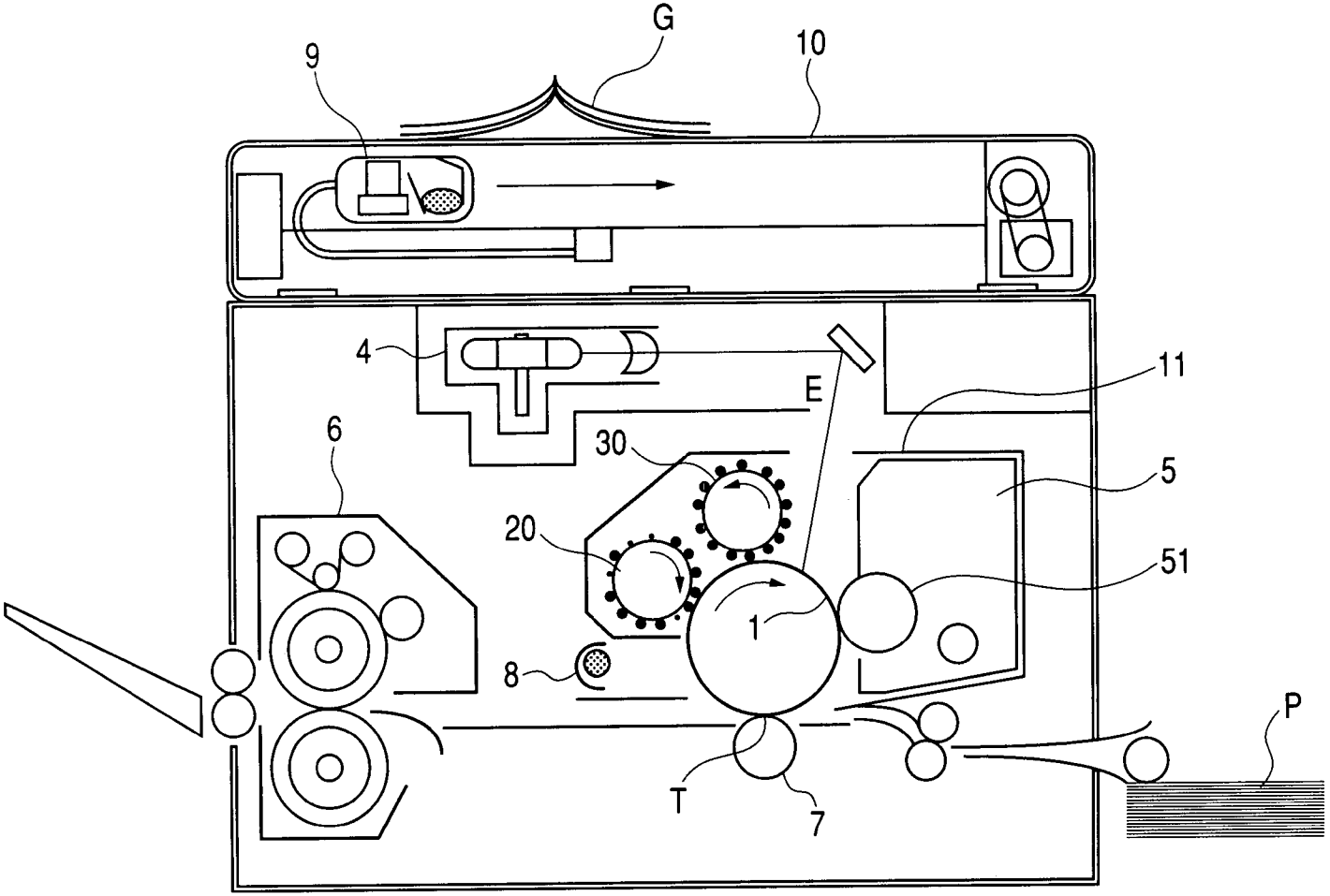
FIG. 1 is a view schematically illustrating the structure of an image forming apparatus of an embodiment according to the present invention.

An image forming apparatus of a first embodiment includes a photosensitive member (an image bearing member) 1 as illustrated in FIG. 1. Around the photosensitive member 1, the following members are provided along its rotational direction (a direction of an arrow R1) approximately in the following order: a first charging unit 2 for charging toner on the photosensitive member 1 as well as the surface of the photosensitive member 1; a second charging unit 3 for charging the toner on the photosensitive member 1; an exposing apparatus (an electrostatic image forming unit) 4 for forming an electrostatic image on the image bearing member based on image information; a developing apparatus (a developing unit) 5 for carrying toner on a developing sleeve, collecting the toner on the image bearing member and visualizing the electrostatic image on the image bearing member to form a toner image; a transferring roller (a transferring unit) 7 for transferring the toner image on the image bearing member to a recording material; and an electrostatic image eliminating unit 8 for eliminating the electrostatic image on the image bearing member after the transfer to approximately uniform a surface potential of the image bearing member. Further, there is disposed a fixing apparatus (a fixing unit) 6 downstream of the transferring roller 7 along a conveyance direction (a direction of an arrow K) of the recording material P.

Figure 2:
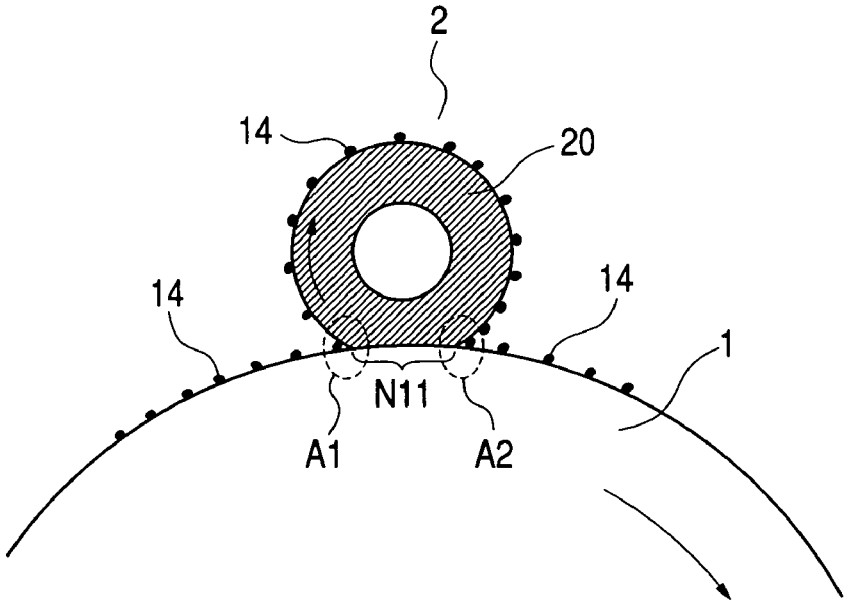
FIG. 2 is a view illustrating a manner in which a charging roller rotated in the same direction as the rotational direction of an image bearing member charges the image bearing member.

FIG. 2 schematically illustrates a situation in which the first charging roller 20 electrifies the photosensitive member 1. The first charging roller 20 is rotated clockwise in the same direction as the rotational direction of the photosensitive member 1 by a driving unit (not shown). A voltage of a negative polarity is applied to the first charging roller 20. The photosensitive member 1 is charged at a potential that is suitable for formation of the electrostatic image. Since the first charging roller 20 is rotated in the same direction as the rotational direction of the photosensitive member 1, the toner on the photosensitive member 1 is moved to the first charging roller 20 as discussed above. Accordingly, the first charging roller 20 is brought into direct contact with the photosensitive member 1, and the photosensitive member 1 is appropriately electrified.

Figure 3:
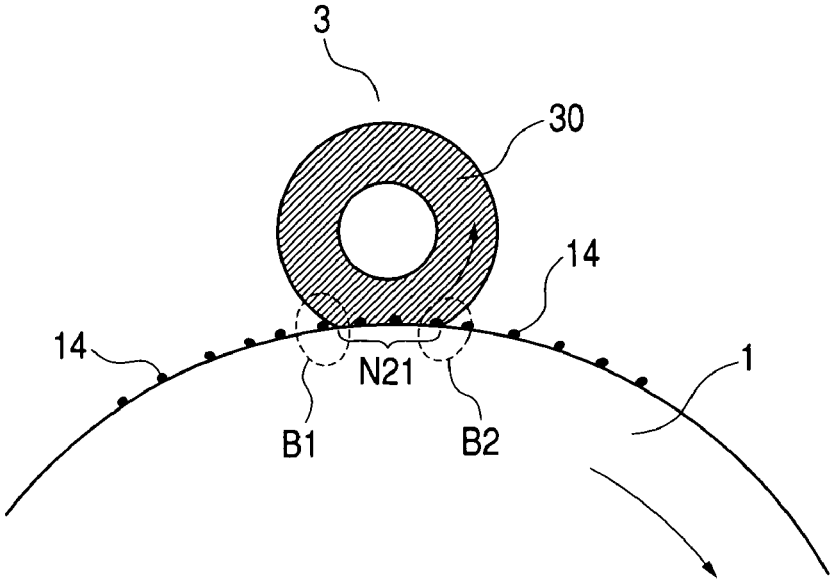
FIG. 3 is a view illustrating a manner in which a charging roller rotated in a direction opposite to the rotational direction of an image bearing member charges toner.

FIG. 3 schematically illustrates a situation in which a second charging roller 30 electrifies the toner. The second charging roller 30 is rotated in a direction opposite to the rotational direction of the photosensitive member 1 by a driving unit (not shown). A voltage of a negative polarity, which is the same polarity of the voltage applied to the first charging roller 20, is applied to the second charging roller 30. The charge suitable for collection by the developing apparatus 5 is given to the toner 14 on the photosensitive member 1.

In FIG. 3, the second charging roller 30 is rotated in the direction opposite to the rotational direction of the photosensitive member 1 as discussed above. During this rotation, the toner 14 on the photosensitive member 1 is moved to a contact region N21 at an end portion B1 upstream of the rotational direction of the photosensitive drum 1 in the contact region N21 between the photosensitive member 1 and a toner charging roller 3, and accordingly residual toner on the image bearing member 1 is not accumulated at the end portion B1. Therefore, the toner 14 is brought into direct contact with the second charging roller 30, and the toner 14 on the photosensitive member 1 is appropriately electrified. Further, the second charging roller 30 does not rub off the toner 14 from the image bearing member 1, so that the toner 14 on the image bearing member 1 passes through the contact portion N21 between the second charging roller 30 and the photosensitive member 1. Accordingly, the toner is in contact with the second charging roller 30 for longer period of time, and hence the charge is stably imparted to the toner.

As discussed above, the charge can be appropriately imparted to the toner remaining on the image bearing member 1 even when much residual toner remains on the image bearing member 1. Thus, it is possible to solve the problem that toner is likely to attach to the non-image portion in the image zone.

Further, in the event that a toner containing electrically-conductive particles is used, the charge can be more appropriately imparted to the toner 14. The reason therefore is that the conductive particles act as electrodes, and hence contact areas between the toner 14 and the first and second charging rollers 20 and 30 substantially increase.

The structure of the image forming apparatus and constituent members of this embodiment will be described in detail in the following discussion.

Specific fabrication examples and embodiments of the present invention described in the following discussion are by no means considered to limit the scope of the present invention. Unit parts in the following blends are parts by weight.

(Electrically-Conductive Fine Powder or Pulverized Matter)

Electrically-conductive fine powder 13 is fine particles of zinc oxide (its electric resistivity is 1500 Ω·cm, and its permeability is 35%) obtained by a wind-force classification of particles obtained by granulating primary particles of zinc oxide with primary particle diameters of 0.1 μm to 0.3 μm using pressure. Its volume average particle diameter is 1.5 μm, its percentage by volume of particles with diameters equal to or less than 0.5 μm in the grit distribution is 35% by volume, and its percentage by number of particles of particles with diameters equal to or greater than 5 μm is 0% by number of particles.

The electrically-conductive fine powder 13 included primary particles of zinc oxide with diameters of 0.1 μm to 0.3 μm, and cohesion matter with diameters of 1 μm to 4 μm as observed in magnifying powers of 300 and 30000 by a scanning electron microscope.

The permeability of the conductive fine powder 13 was about 35% when a light source at a wavelength of 740 nm was used in accordance with a wavelength 740 nm of exposure light of a laser beam scanner used for image exposure in the image forming apparatus of this embodiment, and the permeability in this wavelength range was measured by a 310 t transmission densitometer produced by X-Rite Co.

Production examples of the first and second charging rollers 20 and 30 serving as charging units, and the photosensitive member 1 used in this embodiment will be described.

(Production Example of the Charging Unit)

A charging roller of an elastic member with a diameter of 12 ϕ and a length of 234 mm was fabricated by using an SUS roller with a diameter of 6 ϕ and a length of 264 mm as its core metal, forming around the core metal a roller-shaped layer of medium-resistivity foamed urethane obtained by treatment of urethane resin, carbon black of conductive particles, sulfurating agent, foamable agent, and the like, and adjusting its shape and its surface with cutting and grinding.

The thus-fabricated charging roller exhibited its resistivity of 105 Ω·cm, and its hardness of ASKER C 30 degrees.

(Photosensitive Member of Amorphous Silicon Series)

As a negatively-charged drum with a buffer by a VHF-PCVD method, a photoreceptive member to be used under a negatively charged condition was accomplished by sequentially layering a preventive underlayer, a photoconductive layer, a buffer layer, and a surface layer in this order on a cylindrical A1 substrate body under conditions shown in Table 1 using a plasma CVD apparatus by VHF.

TABLE 1

| | | |
|---|---|---|
| Preventive underlayer | | |
| $SiH_4$ | 200 | ml/min (normal) |
| $H_2$ | 400 | ml/min (normal) |
| $PH_3$ | 500 | ppm (for $SiH_4$) |
| NO | 15 | ml/min (normal) |
| Power | 180 | W (105 MHz) |
| Inner pressure | 1.3 | Pa |
| Temperature of substrate | 300° | C. |
| Layer thickness | 2 | μm |
| Photoconductive layer | | |
| $SiH_4$ | 300 | ml/min (normal) |
| $H_2$ | 500 | ml/min (normal) |
| $B_2H_6$ | 0.3 | ppm (for $SiH_4$) |
| Power | 450 | W (105 MHz) |
| Inner pressure | 1.3 | Pa |
| Temperature of substrate | 300° | C. |
| Layer thickness | 28 | μm |
| Buffer layer | | |
| $SiH_4$ | 50 | ml/min (normal) |
| $CH_4$ | 50 | ml/min (normal) |
| Power | 450 | W (105 MHz) |
| Inner pressure | 1.3 | Pa |
| Temperature of substrate | 300° | C. |
| Layer thickness | 0.5 | μm |
| Surface layer | | |
| $CH_4$ | 150 | ml/min (normal) |
| Power | 1000 | W (105 MHz) |
| Inner pressure | 1.3 | Pa |
| Temperature of substrate | 100° | C. |
| Layer thickness | 0.1 | μm |

An electrophotographic image forming apparatus according to the present invention will be described in detail in the following discussion.

Figure 4:
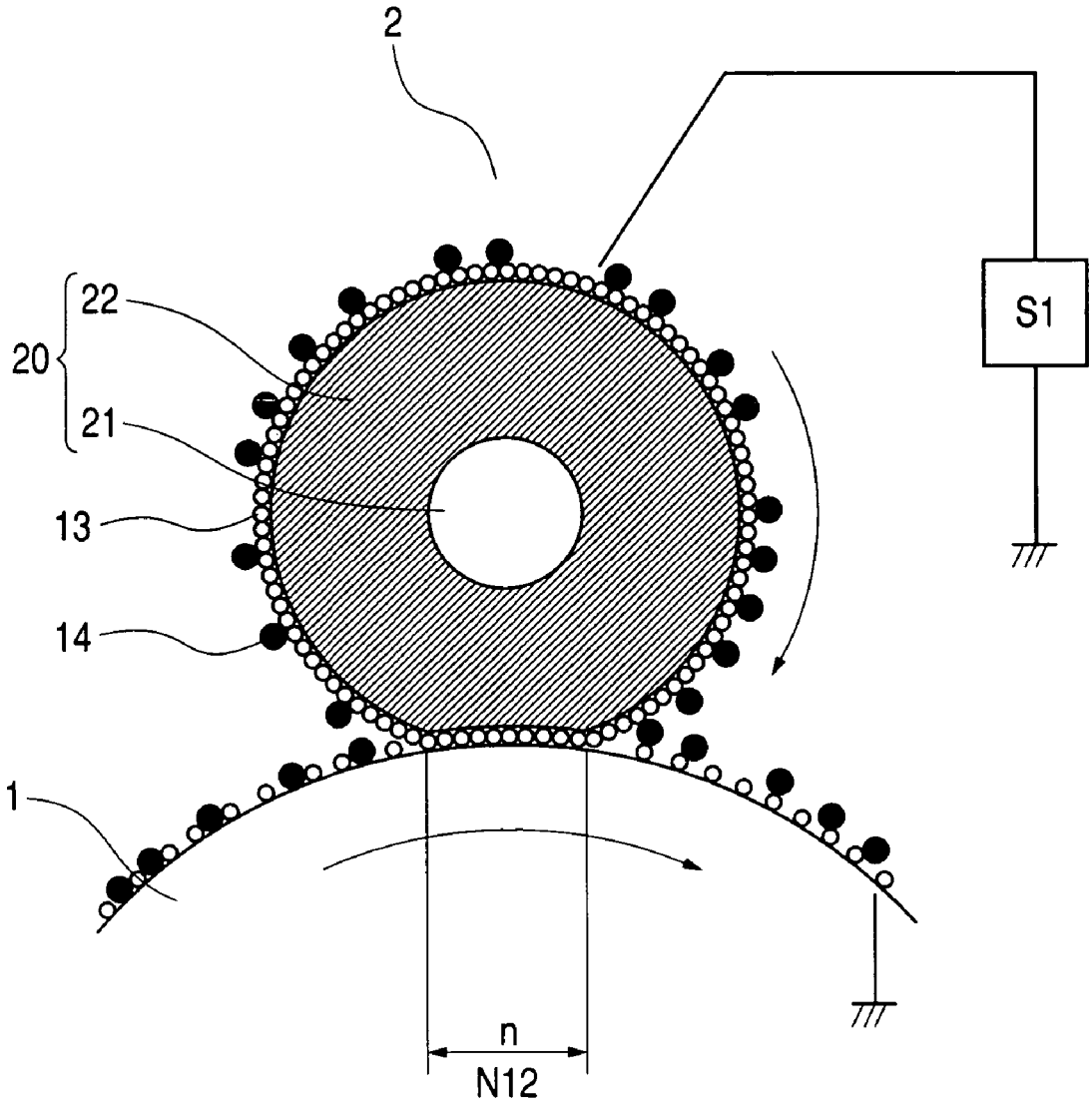
FIG. 4 is a view illustrating a manner in which a charging roller rotated in the same direction as the rotational direction of an image bearing member charges the image bearing member in the even that toner including fine particles is used.
Figure 5:
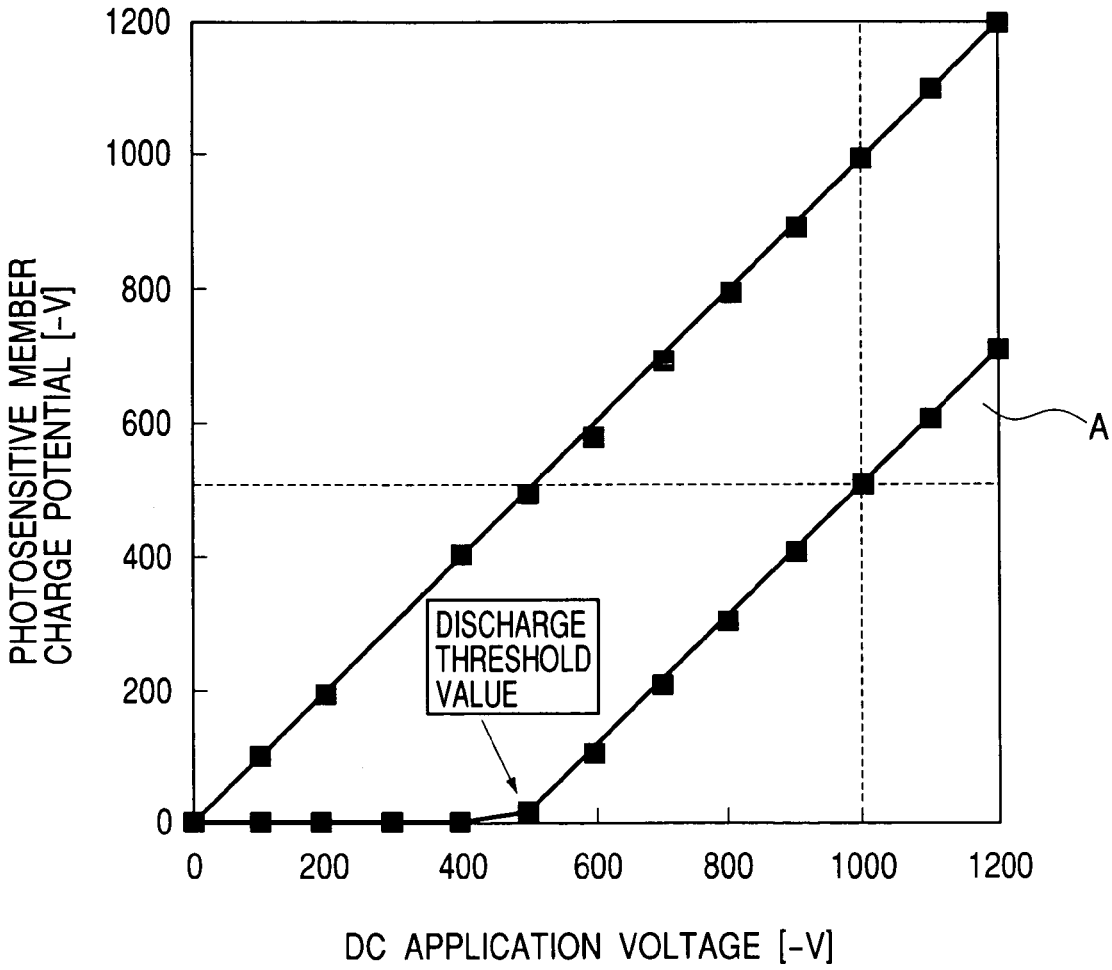
FIG. 5 is a view showing the charging efficiency in a conventional charging system.
Figure 6:
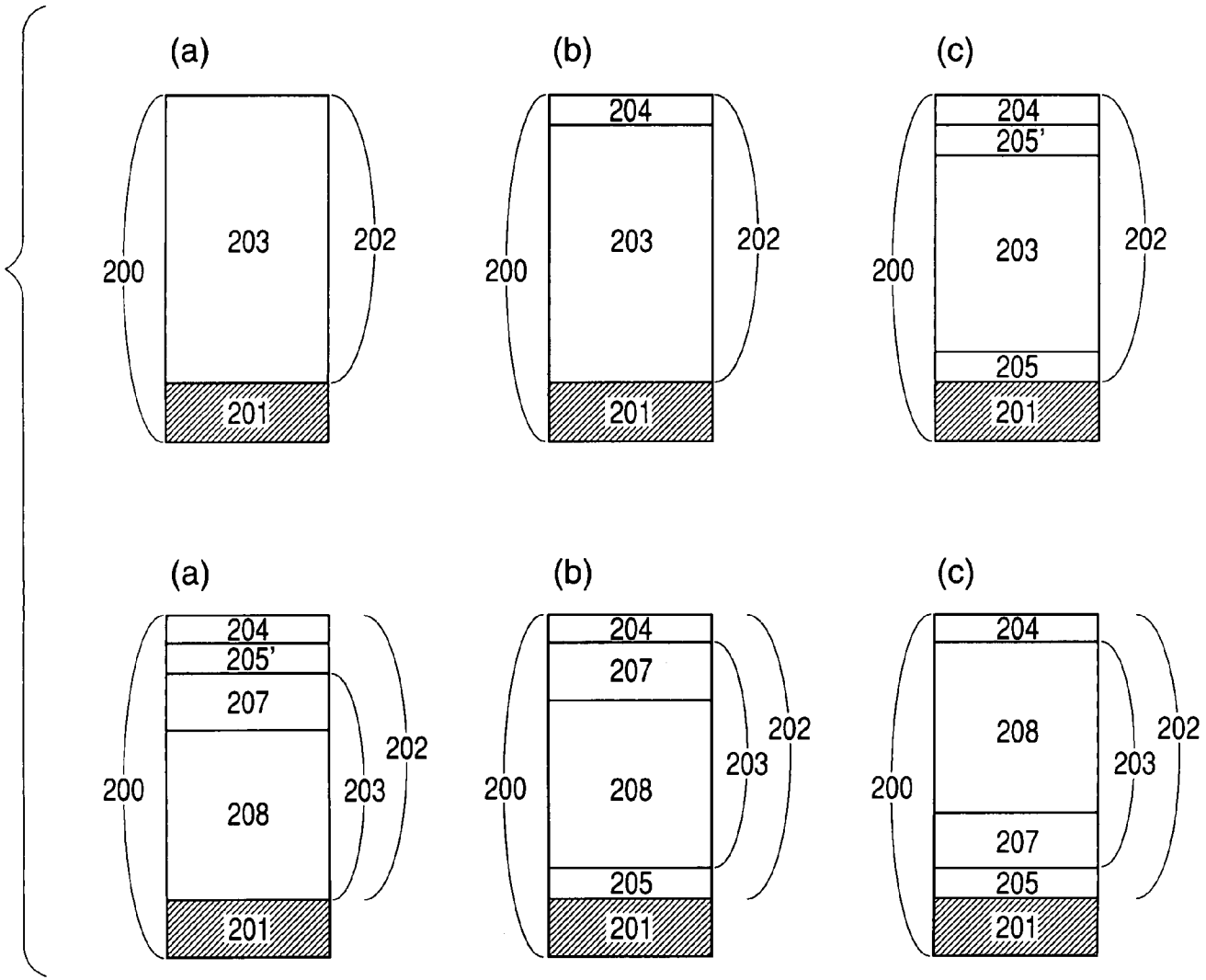
FIG. 6 is a view schematically illustrating the layer structure of a photosensitive member of amorphous silicon series.
Figure 7:
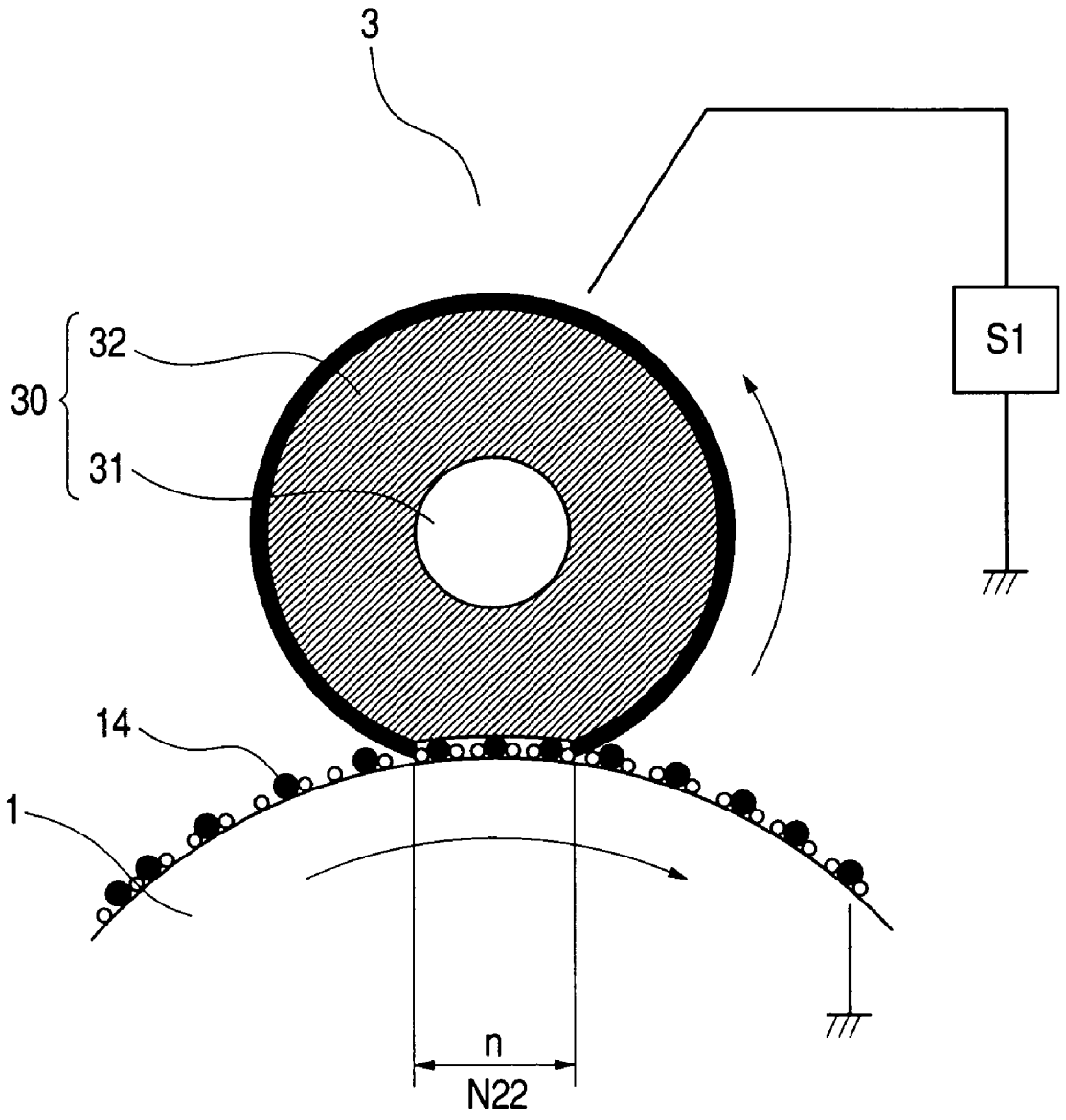
FIG. 7 is a view illustrating a manner in which a charging roller rotated in a direction opposite to the rotational direction of an image bearing member charges the image bearing member in the even that toner including fine particles is used.

FIG. 1 is a schematic cross-sectional view illustrating an embodiment of the image forming apparatus. FIGS. 4 and 7 are schematic views illustrating contact charging apparatuses, respectively.

In FIG. 1, upon input of a copy start signal, the photosensitive member 1 of amorphous silicon series (a-Si) is rotated in a direction of the arrow, is subjected to uniform elimination of charge by the pre-exposure lamp 8, and is then uniformly charged by the first charging roller 20 to show a predetermined potential. Here, the photosensitive member 1 is an electrophotographic photosensitive member of a rotary drum type, and is rotated in a clockwise direction indicated by the arrow at a process speed (a circumferential speed) of 100 mm/sec.

The first and second charging devices 2 and 3 are charging rollers in contact with the photosensitive member 1, respectively. As illustrated in FIG. 4, the first charging roller 20 of the first charging device 2 is rotated clockwise (indicated by an arrow) in the same direction as the rotational direction of the photosensitive member 1. As illustrated in FIG. 3, the second charging roller 30 of the second charging device 3 is rotated counterclockwise (indicated by an arrow) in a direction opposite to the rotational direction of the photosensitive member 1. The photosensitive member 1 is electrified by the first charging roller 20 in a contact portion N12 between the photosensitive member 1 and the first charging roller 20 illustrated in FIG. 4. The conductive fine powder 13 is present in the contact portion N12. In this embodiment, toner containing the conductive fine powder 13 is used.

As discussed above, since the toner 14 is scraped by the first charging roller 20 rotated in the same direction as the rotational direction of the photosensitive member 1, the toner 14 is not moved to the contact portion N12. However, the conductive fine powder 13 is by no means scraped by the first charging roller 20 since the conductive fine powder 13 is small. Accordingly, the electrically-conductive fine particle 13 is present in the contact portion N12.

A charging bias created by superimposition of a DC voltage of 500 V and an AC square voltage at a frequency of 1 kHz and with a peak-to-peak voltage of 200 V is applied to the first charging roller 20 by an electric power source S1 as illustrated in FIG. 4. The peripheral surface of the photosensitive member 1 is uniformly charged at about −450 V by a direct injection electrification method.

On the other hand, in a reader portion, an original G placed on an original support 10 is irradiated with and scanned by light from a unit 9 of an original illuminating lamp, a short focal length lens array, and a CCD sensor. Reflective light of illuminating scan light reflected by the original surface is imaged by the short focal length lens array, and is input into the CCD sensor. The CCD sensor is comprised of a light receiving portion, a transfer portion, and an output portion. The optical signal is converted into a charge signal in the CCD light receiving portion, and the charge signal is sequentially transferred to the output portion in synchronization with a clock pulse in the transfer portion. The charge signal is further converted into a voltage signal in the output portion, and the voltage signal is amplified and output as a signal with a lowered impedance. The thus-obtained analog signal is subjected to conventional image treatment, is converted into a digital signal, and is supplied to a printer portion.

In the printer portion, the charged surface of the photosensitive member 1 undergoes scan exposure E of a laser beam output from a laser exposing unit 4 (a solid-state laser device, a high-speed rotating polygon mirror, and the like), intensity of which is modulated corresponding to the above-discussed digital signal of image information. An electrostatic latent image corresponding to the image information of the image on the original is formed on the peripheral surface of the photosensitive member 1 by the above-discussed scan exposure E. The electrostatic latent image is developed as a toner image by the developing device 5 using a magnetic one-component insulating toner.

Further, simultaneously with the development, toner present in the non-image zone on the photosensitive member 1 is collected. Reference numeral 51 designates a non-magnetic developing sleeve with a diameter of 16 mm which contains a magnet roller (not shown).

The developing sleeve 51 is coated with toner charged in a negative polarity. The developing sleeve 51 is held in a stationary state keeping a distance of 200 $\mu$m away from the surface of the photosensitive member 1, and is rotated at the same speed as the photosensitive member 1.

A developing bias voltage is applied to the developing sleeve 51 by a developing bias electrical power source (not shown). A voltage created by superimposition of a DC voltage of −350 V and an AC square voltage at a frequency of 1.8 kHz and with a peak-to-peak voltage of 1.6 kV is applied to the developing sleeve 51. Jumping development is thus performed between the developing sleeve 51 and the photosensitive member 1.

On the other hand, a transferring material P serving as the recording material is supplied from a sheet feeding portion. The transferring material P is guided into a pressure contact nip portion (a transferring portion) T between the photosensitive member 1 and the transferring roller 7 serving as a contact transferring unit in a predetermined timing. A predetermined transferring bias voltage is applied to the transferring roller 7 from a transferring bias applying electrical power source (not shown).

In this embodiment, the transferring roller with a resistance value of $5\times10^8$ Ω is used, and a DC voltage of +2000 V is applied to the transferring roller to perform transferring.

The transferring material P introduced into the transferring portion T is nipped and conveyed through the transferring portion T. The toner image formed and held on the surface of the photosensitive member 1 is sequentially transferred to a front surface of the transferring material P by electrostatic force and pressing force.

Further, the transferring material P subjected to transfer of the toner image is released from the surface of the photosensitive member 1. The transferring material P is then guided into the fixing apparatus 6 of a heat-fixing type or the like, and is subjected to fixation of the toner image. The transferring material P is finally discharged from the apparatus.

The electrophotographic apparatus of this embodiment is directed to an apparatus of a cartridge type in which four process devices of the photosensitive member 1, the first charging device 2, the second charging device 3, and the developing apparatus 5 are contained in a cartridge 11, and the cartridge 11 is detachably attachable to a main body of the apparatus, and is replaceable in a unit. Application of the present invention is, however, not limited to this cartridge type.

The first and second charging devices 2 and 3 used in this embodiment will be described.

In FIG. 4, the first charging unit 2 is an apparatus using the first charging roller 20 as the contact charging member, which is fabricated by forming around a core metal 21 a medium-resistivity layer 22 formed of rubber or foamed substance serving as the elastic member. A voltage is applied to the first charging unit 2 by the charging bias electrical power source S1.

The first charging roller 20 is arranged approximately parallel to the photosensitive member 1 serving as the image bearing member. Opposite ends of the core metal 21 are supported by bearings, and the first charging roller 20 is brought into pressure contact with the photosensitive member 1 against elasticity of the medium-resistivity layer 22 by a predetermined pressing force. The contact portion N12 is thus formed between the first charging roller 20 and the photosensitive member 1. Although the width of the contact portion N12 is not specially restricted, it is preferably equal to 1 mm or more, and more preferably 2 mm or more such that a close contact can be stably established between the first charging roller 20 and the photosensitive member 1.

As driving conditions of the first charging roller 20, a ratio or difference between the circumferential speeds is preferably equal to −105% or more in view of electrification characteristics (a level at which unevenness in sliding friction due to the electrically-conductive fine particles 13 is not noticeable), and is preferably equal to −120% or more in view of normalization and discharging characteristics of the residual toner 14 on the image bearing member, where the ratio or difference between the circumferential speeds is defined by the ratio between the circumferential speeds (%)={(the circumferential speed-of the first charging roller) −(the circumferential speed of the photosensitive member)}/(the circumferential speed of the photosensitive member) ×100. Here, the circumferential speed of the first charging roller is positive when the surface of the first charging roller moves in the same direction as the surface of the photosensitive member in the contact portion.

In FIG. 7, the second charging device 3 is an apparatus using the second charging roller 30 as the contact charging member. Like the first charging roller 20, the second charging roller 30 is fabricated by forming around a core metal 31 a medium-resistivity layer 32 formed of rubber or foamed substance serving as the elastic member. Further, together with the first charging roller 20, a voltage is also applied to the second charging roller 30 by the electrical power source S1.

Like the first charging roller 20, the second charging roller 30 is also disposed approximately parallel to the photosensitive member 1. Opposite ends of the core metal 31 are supported by bearings, and the second charging roller 30 is brought into pressure contact with the photosensitive member 1 against elasticity of the medium-resistivity layer 32 by a predetermined pressing force. The contact portion N22 is thus formed between the second charging roller 30 and the photosensitive member 1. Although the width of the contact portion N22 is not specially restricted, it is preferably equal to 1 mm or more, and more preferably 2 mm or more such that a close contact can be stably established between the second charging roller 30 and the photosensitive member 1.

The second charging roller 30 is rotated in a counter-clockwise direction opposite to the rotational direction of the photosensitive member 1 with a difference in the speed between the second charging roller 30 and the photosensitive member 1. Under such a condition, the toner 14 is moved to the contact portion N22 since the second charging roller 30 does not scrape off the toner on the photosensitive member 1. Accordingly, a bias is applied to the second charging roller 30 by the electrical power source S1, and the toner is appropriately charged.

The toner 14 reaching the second charging roller 30 through the first charging roller 20 is electrified in the contact portion N22 between the second charging roller 30 and the photosensitive member 1. The amount of charge of the residual toner 14 remaining on the image bearing member subsequent to normalization by the toner charging roller 30 was measured, and the measured value was −5 μC/g.

As driving conditions of the second charging roller 30, the ratio or difference between the circumferential speeds is preferably equal to −0.05% or less, or equal to +0.1% or more, in view of electrification characteristics (a level at which unevenness in the sliding friction due to the electrically-conductive fine particles 13 on the second charging roller 30 can be reduced), and is preferably equal to +0.1% or more in view of appropriate charging for the toner 14 on the photosensitive member 1.

A further description will be made to behaviors of toner generating particles and electrically-conductive fine powder 13 during an image forming process in the event that the conductive fine powder 13 is externally added to the toner generating particles.

At the time of development of the electrostatic latent image on the photosensitive member 1 in the developing process (not shown), an appropriate amount of the electrically-conductive fine powder 13 contained in the toner 14 is moved to the photosensitive member 1 together with the toner generating particles.

The toner image on the photosensitive member 1 is transferred to the recording medium (not shown) during the transferring process (not shown). Although a portion of the conductive fine powder 13 on the photosensitive member 1 is attached to the recording medium, the rest thereof is attached to and held on the photosensitive member 1, and remains thereon. In the event that transferring is performed applying a transferring bias in a polarity opposite to that of the toner 14, the toner 14 is attracted to the side of the recording medium P, and is positively transferred thereto. However, the conductive fine powder 13 on the photosensitive member 1 is not positively transferred to the side of the recording medium P due to its electrical conductivity. Therefore, although a portion of the conductive fine powder 13 is attached to the recording medium P, the rest thereof is attached to and held on the photosensitive member 1, and remains thereon.

In the apparatus of the present invention without using the cleaning apparatus, the residual toner 14 and the above-discussed residual conductive fine powder 13 remaining on the photosensitive member 1 after the transferring process are carried to the contact portion N12 between the photosensitive member 1 and the first charging roller 20 and the contact portion N22 between the photosensitive member 1 and the second charging roller 30 as the photosensitive member 1 moves.

Accordingly, the direct injection electrification of the photosensitive member 1 is executed under a condition under which the conductive fine powder 13 is interposed in the contact portions between the photosensitive member 1 and the image bearing member charging roller 20 and between the photosensitive member 1 and the toner charging roller 30.

Further, the toner 14 charged by the image bearing member charging roller 20 and the toner charging roller 30 reaches the developing portion as the photosensitive member 1 moves, and cleaning simultaneous with developing (collection of the toner) is performed during the developing process.

Furthermore, due to repetition of the image formation, the conductive fine powder 13 contained in the toner is moved to the photosensitive member 1 in the developing portion, and is carried to the first charging roller 20 and the second charging roller 30 through the transferring portion as the photosensitive member 1 is rotated. Therefore, even if the conductive fine powder 13 is subjected to decrease in its amount, degradation and the like due to falling and so forth, electrification characteristics of the first and second charging rollers 20 and 30 are prevented from being lowered such that favorable electrification characteristics can be stably maintained.

As discussed above, due to provision of the second charging roller 30 rotating in the direction opposite to the rotational direction of the photosensitive member 1, the toner on the photosensitive member 1 can be appropriately charged, and the toner 14 on the non-image portion in the image zone can be collected by the developing device 5. Hence, it is possible to solve the problem that the residual toner 14 remains on the non-image portion in the image zone. Further, due to the electrically-conductive fine powder 13 contained in the toner, the toner on the photosensitive member 1 can be more appropriately electrified.

Another embodiment of the present invention will be described. In this embodiment, the first charging device 20, the second charging device 30, and other constituent members are the same as those of the image forming apparatus of the first embodiment discussed above. Further, the same voltage is applied to each of the first and second charging rollers 20 and 30 from the electrical power source S1.

In the image forming apparatus of the second embodiment, the voltage applied to each of the first and second charging rollers 20 and 30 during the image forming operation is different from that during the image non-forming operation (a pre-rotation process, an inter-sheet process, a post-rotation process, and the like). Specifically, a peak-to-peak voltage of an AC voltage applied to each of the first and second charging rollers 20 and 30 during the image non-forming operation is set larger than that during the image forming operation.

Figure 8:
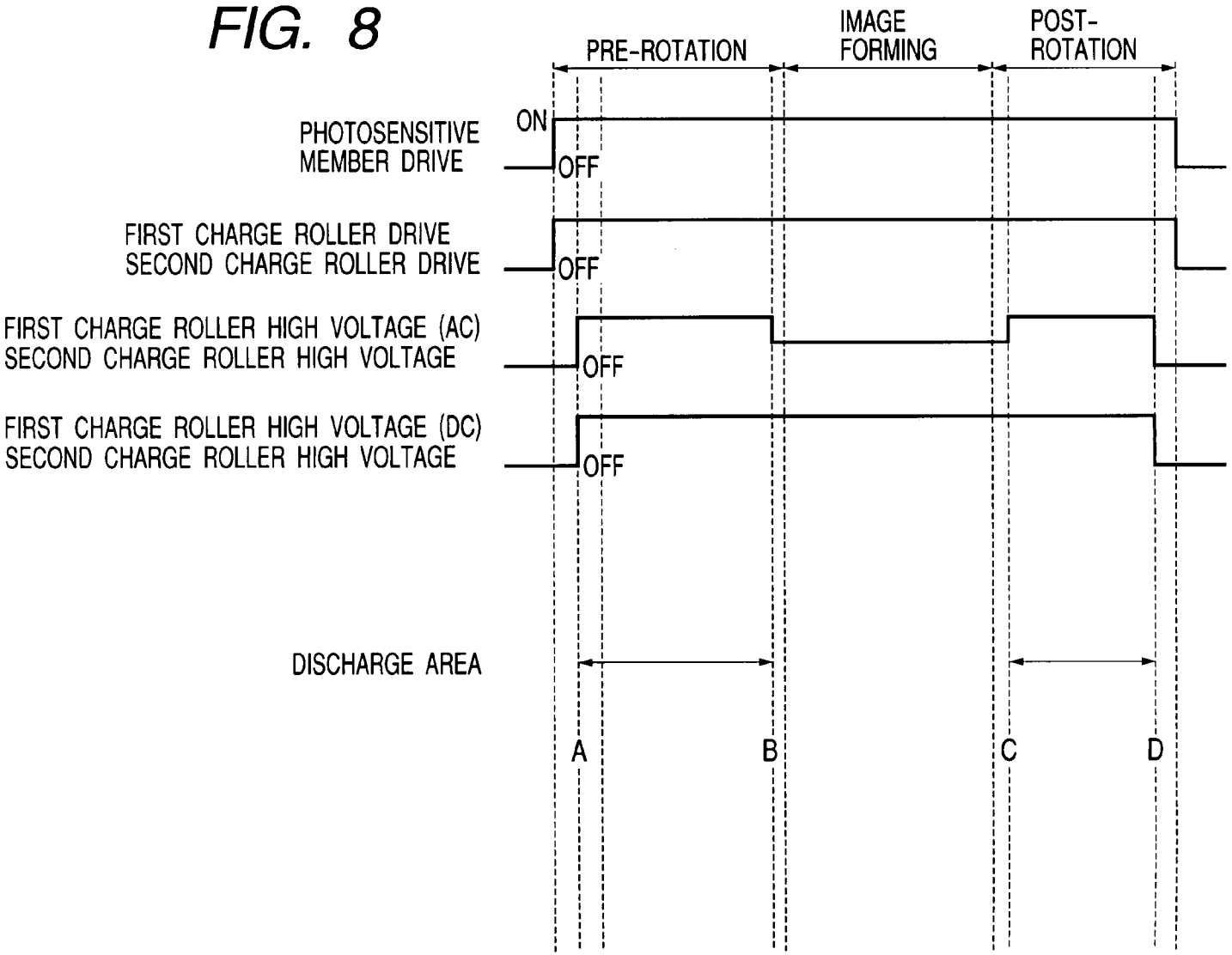
FIG. 8 is a view showing a first control method of a discharge mode according to the present invention.

FIG. 8 shows a timing in which the voltage is applied to each of the first and second charging rollers 20 and 30, and a timing in which each of the first and second charging rollers 20 and 30 is driven.

In the second embodiment, a DC voltage (−500 V), and an AC voltage (its peak-to-peak voltage is 200 V, and its frequency is 1 kHz) are used as a bias applied to each of the first and second charging rollers 20 and 30. The AC voltage applied at this time is not discharged.

A portion of the toner 14 on the photosensitive member 1 is largely charged in a positive polarity. When the toner 14 largely charged in a positive polarity is attached to the first charging roller 20 to which a bias of a negative polarity is applied, the toner remains on the first charging roller 20 regardless of the scraping action by the photosensitive member 1. Generally, such residual toner does not influence the capability of the first charging roller 20 for charging the photosensitive member 1. If, however, a large amount of toner is accumulated, this charging capability decreases. Therefore, it is necessary to occasionally apply an AC voltage with a large peak-to-peak voltage to the first charging roller 20 to remove the toner attached to the first charging roller 20, and collect the removed toner by the developing device 5.

It is most preferable to remove the toner attached to the first charging roller 20, and collect the removed toner by the developing device 5 during the image non-forming time. In other words, the cleaner-less mechanism adopted in the present invention, the toner attached to the non-image region is collected by the developing device 5. Therefore, it is most optimum to remove the toner attached to the first charging roller 20 during the image non-forming time in which an area of the non-image region is largest, in the light of the fact that the thus-removed toner is collected by the developing device 5.

The toner 14 is also attached to the second charging roller 30 in the event that the image forming apparatus is used for a long period of time. Accordingly, since the charging capability of the second charging roller 30 for the toner 14 is lowered, it is necessary to occasionally remove the toner attached to the second charging roller 30. An AC voltage with a large peak-to-peak voltage is applied to the second charging roller 30 to remove the toner 14 therefrom. For the same reason as that in the above case of removal of the toner attached to the first charging roller 20, it is most optimum to remove the toner attached to the second charging roller 30 during the image non-forming time in which an area of the non-image region is largest.

At the time (indicated by a dotted line A) when biases applied to the first and second charging rollers 20 and 30 reach stationary states, removing operation of the toner attached to the first charging roller 20 is started to begin removing the toner 14 attached to the first charging roller 20. Upon finishing the removal of the toner attached to the first charging roller 20 (indicated by a dotted line B), the peak-to-peak voltage of the AC voltage applied so far is changed to a lower value prior to the image formation.

After finish of the image formation (indicated by a dotted line C), an AC voltage with a large peak-to-peak voltage is superimposed to re-start the removal of the toner attached to the first charging roller 20 during the so-called post-rotation process. The removal of the toner from the first charging roller 20 during the post-rotation process is continued for a predetermined period of time, and is then finished (indicated by a dotted line D). The Ac voltage supplied to each of the first and second charging rollers 20 and 30 from the electrical power source S1 is stopped, and application of the DC voltage is then stopped. Thus, drives of the first charging roller 20, the second charging roller 30, and the photosensitive member 1 are ceased in this order.

Still another embodiment of the present invention will be described. In this embodiment, the first charging device 20, the second charging device 30, and other constituent members are the same as those of the image forming apparatus of the embodiments discussed above, with the exception of the electrical power sources for applying biases to the first and the second charging rollers 20 and 30. The electrical power source for applying the bias to the first charging roller 20 is not common to that for applying the bias to the second charging roller 30. The voltage is applied to the first charging roller 20 by the electrical power source S1, while the voltage is applied to the second charging device 30 by the electrical power source S2.

This embodiment is characterized by an AC voltage applied to the second charging roller 30. In other words, the voltage applied to the second charging device 30 during the image forming operation is different from that during the image non-forming operation (the pre-rotation process, the post-rotation process, and the like). Specifically, a peak-to-peak voltage of the AC voltage applied to the second charging devices 30 during the image non-forming operation is set larger than that during the image forming operation.

The toner 14 is also attached to the second charging roller 30 in the even that the image forming apparatus is used for a long period of time. Accordingly, since the charging capability of the second charging roller 30 for the toner 14 is lowered, it is necessary to occasionally remove the toner 14 attached to the second charging roller 30. An AC voltage with a large peak-to-peak voltage is applied to the second charging roller 30 to remove the toner 14 therefrom. For the same reason as that of the above-discussed second embodiment, it is most optimum to remove the toner 14 attached to the second charging roller 30 during the image non-forming time in which an area of the non-image region is largest.

Figure 9:
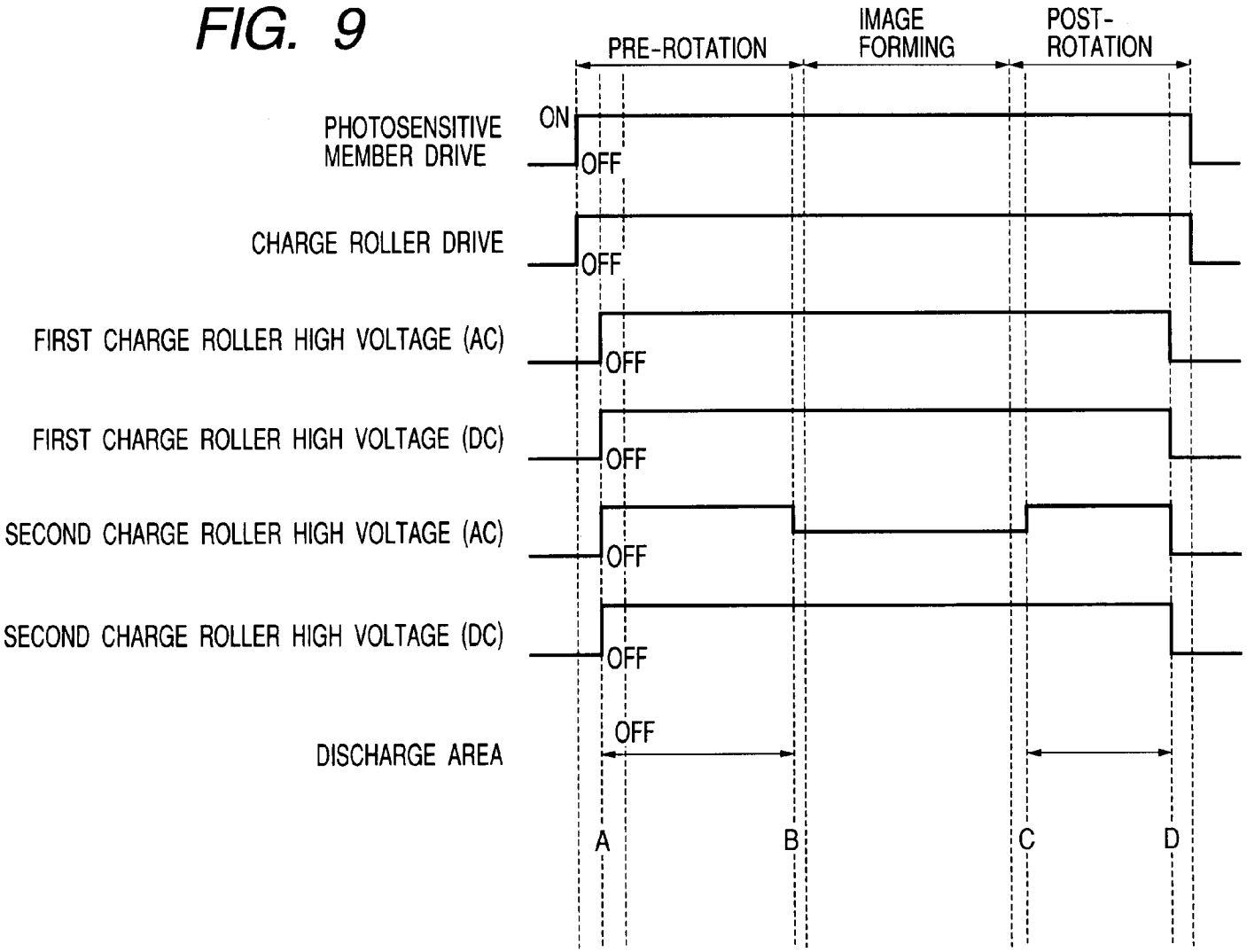
FIG. 9 is a view showing a second control method of a discharge mode according to the present invention.

FIG. 9 is a sequence chart showing drives of and application of voltages to the first and second charging rollers 20 and 30 in the image forming apparatus of this embodiment.

In FIG. 9, during the pre-rotation process performed prior to the image formation, drives of the photosensitive member 1, the first charging roller 20, and the second charging roller 30 are started in this order. With respect to a high voltage to be applied to the second charging roller 30 from the power source S2, a DC voltage (−500 V), and an AC voltage (its peak-to-peak voltage is 200 V, and its frequency is 1 kHz) are initially applied. The AC voltage applied at this time is set so as not to cause discharge.

At the time (indicated by a dotted line A) when the bias applied to the second charging roller 30 reaches a predetermined voltage, removing operation of the toner 14 attached to the second charging roller 30 is started. After the removing operation of the toner 14 attached to the second charging roller 30 is executed for a predetermined period of time, removal of the toner 14 during the pre-rotation process is finished (indicated by a dotted line B). Further, the peak-to-peak voltage of the AC voltage is changed to a lower value prior to the image formation.

After finish of the image formation (indicated by a dotted line C), an AC voltage with a large peak-to-peak voltage is applied in the so-called post-rotation process. And, the removal of the toner 14 attached to the second charging roller 30 is again started. After the removal of the toner 14 is performed for a predetermined period of time, the removing operation of the toner 14 attached to the second charging roller 30 during the post-rotation process is finished (indicated by a dotted line D). Application of the AC voltage supplied to the second charging roller 30 from the electrical power source S2 is stopped, and application of the DC voltage is then stopped. Thus, drives of the second charging roller 30, and the photosensitive member 1 are ceased in this order.

The removal of the toner 14 attached to the second charging roller is performed during the pre-rotation and post-rotation processes in the embodiment, but the present invention is not limited thereto. It is similarly effective to perform such removal during the inter-sheet process.

In the above-discussed embodiments, a description is made only to the case where the photosensitive member of amorphous silicon series (a-Si) is used. However, the same technical advantages could be obtained even in the event that an organic photosensitive member (OPC) was used.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image bearing member capable of being rotated;

first charging means capable of being rotated in the same direction as a rotational direction of said image bearing member with being in contact with said image bearing member, and capable of charging said image bearing member and toner on said image bearing member;

electrostatic image forming means capable of forming an electrostatic image on said image bearing member charged by said first charging means;

developing means capable of collecting the toner on said image bearing member and visualizing the electrostatic image; and second charging means, said second charging means being disposed downstream of said first charging means along the rotational direction of said image bearing member, capable of being rotated in a direction opposite to the rotational direction of said image bearing member with being in contact with said image bearing member, and capable of charging the toner on said image bearing member, wherein AC voltages are applied to said first charging means and said second charging means, respectively.

2. An image forming apparatus according to claim 1, wherein the toner contains electrically-conductive particles.

3. An image forming apparatus according to claim 1, wherein DC voltages of the same electrical polarity are applied to said first charging means and said second charging means and superimposed on the AC voltages.

4. An image forming apparatus according to claim 1, wherein a peak-to-peak voltage of the AC voltage applied during an image non-forming time is larger than a peak-to-peak voltage of the AC voltage applied during an image forming time.

* * * * *